United States Patent [19]

Tashiro

[11] Patent Number: 5,044,799

[45] Date of Patent: Sep. 3, 1991

[54] PRINTER

[75] Inventor: Mitsuo Tashiro, Tokyo, Japan

[73] Assignee: Seikosha Co., Ltd., Tokyo, Japan

[21] Appl. No.: 489,401

[22] Filed: Mar. 5, 1990

[30] Foreign Application Priority Data

Apr. 24, 1989 [JP] Japan ..... 1-47945[UM]

[51] Int. Cl.[5] ..... B41J 13/10

[52] U.S. Cl. ..... 400/643; 400/659; 400/693

[58] Field of Search ..... 400/659, 660.1, 661.4, 400/642, 643, 120, 661, 648, 662, 693

[56] References Cited

U.S. PATENT DOCUMENTS 4,327,366 4/1982 Schafter et al. ..... 400/656

4,806,035 2/1989 Maeda ..... 400/642

*Primary Examiner*—Edgar S. Burr

*Assistant Examiner*—Ren Yan

*Attorney, Agent, or Firm*—Jordan and Hamburg

[57] ABSTRACT

A printer includes a paper guide disposed around an outer peripheral portion of a platen to which a print head is opposed. A platen cover is disposed in proximity to the outer periphery of the platen and has an opening at a portion opposed to the print head, a paper passageway being formed between the platen cover and the paper guide.

4 Claims, 1 Drawing Sheet

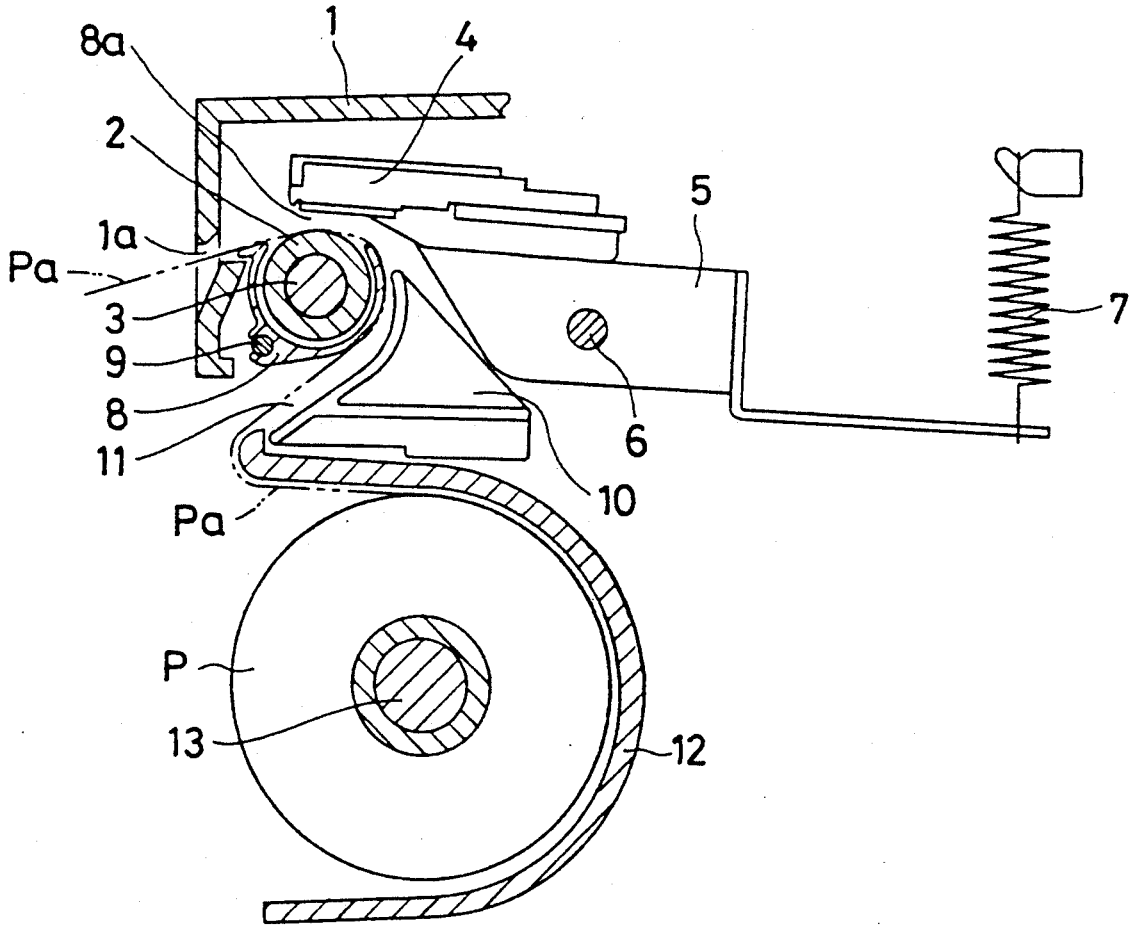
8a
1
4
2
5
1a
Pa
3
7
9
8
6
11
10
Pa
P
13
12

PRINTER

BACKGROUND OF THE INVENTION

The present invention relates to a printer.

A conventional printer is arranged with a rotatable cylindrical platen formed of a material having a high coefficient of friction such as rubber, a paper guide is disposed around an outer peripheral portion of the platen with a predetermined gap therebetween, and a print head is disposed in such a manner as to oppose the platen.

When the paper is loaded on the printer, a leading end of a roll of paper is drawn out, and the paper is inserted into a paper passageway formed between the platen and the paper guide. The paper is then made to pass between the print head and the platen, and is then drawn out of the printer case.

However, since a material having a high coefficient of friction is used as the platen, as described above, the leading end of the paper is brought into contact with the platen at the time of loading the paper. Consequently, the efficiency with which the paper is loaded is poor. In addition, if the paper is loaded in an offset state, the extent to which the paper is wound around the platen becomes large, and the area of contact between the two is large, so that it is extremely difficult to correct the offset. In addition, there have been cases where offsetting or meandering of the paper occurs during conveyance of the paper.

For this reason, there is a printer in which a paper guide is provided with an auxiliary roll so as to make the operation of loading the paper smooth. However, since the paper is brought into contact with the platen in the same manner as described above, there is still the problem of the paper-loading efficiency, and the structure becomes complicated all the more because of the auxiliary roller.

SUMMARY OF THE INVENTION

Accordingly, an object of the present invention is to provide a printer which has excellent efficiency with which the paper is loaded. The above object is achieved by providing a paper guide disposed around an outer peripheral portion of a platen to which a print head is opposed, a platen cover disposed in proximity to the outer periphery of the platen and having an opening at a portion opposed to a print head, and a paper passageway formed between the platen cover and the paper guide.

BRIEF DESCRIPTION OF THE DRAWING

The drawing is a cross-sectional view illustrating one embodiment of the present invention.

DESCRIPTION OF THE PREFERRED EMBODIMENTS

Referring now to the drawing, a cylindrical platen 2 formed of rubber as a basic material is provided in a case 1 of a printer in such a manner as to be rotatable by means of a shaft 3. A print head 4 for thermal printing is provided above the platen 2 in such a manner as to be capable of moving toward and away from the platen 2.

The print head 4 is secured to a distal end of a head supporting plate 5. The supporting plate 5 is pivotally supported by a shaft 6, and a lower end of a spring 7 is retained at the rear end of the supporting plate 5 so that the print head 4 is urged by the resiliency of the spring in a direction into contact with the platen 2. The printer is provided with a non-illustrated mechanism for bringing the print head 4 into contact with the platen 2 or conversely moving the print head 4 away from the platen 2 against the resiliency of the spring.

A platen cover 8 is provided around the outer periphery of the platen 2 in proximity thereto and is secured to the case 1 by means of a shaft 9. The platen cover 8 has a configuration in which an opening 8*a* is provided where the platen 2 is opposed to the print head 4, i.e., above the platen 2 in the drawing, and the remaining portion of the platen cover 8 surrounds the periphery of the platen 2. The platen cover 8 is formed of aluminum as a basic material, and its outer peripheral surface is formed as a smooth surface.

A paper guide 10 is provided on the right-hand side of the outer periphery of the platen 2 with a predetermined interval therebetween, the gap between the paper guide 10 and the platen cover 8 forming a paper passgaeway 11 for thermal sensitive paper Pa.

Roll paper P, from which the theraml sensitive paper Pa is obtained, is held below the paper guide 10 by means of a supporting shaft 13 of a roll paper holder 12. In addition, an opening 1*a* for drawing the paper Pa out of the case 1 is formed in the case 1.

Accordingly, in order to load the printer with the paper Pa, the leading end of the paper Pa is first drawn out from the roll paper P, and the leading end of paper Pa is inserted into an inlet port of the paper passageway 11 between the paper guide 10 and the platen cover 8. The paper Pa is passed through the paper passageway 11 and then passed through the gap between the platen 2 and the print head 4, i.e., through the opening 8*a* of the platen 8, and is then led out from the opening 1*a* of the case 1.

In accordance with the present invention, since the platen cover is provided around the platen, at the time of loading the paper, the leading end of the paper is not brought into contact with the platen and passes through the paper passageway formed between the platen cover and the paper guide. Hence, the loading efficiency is improved. Even if the paper should be loaded in an offset state, since the area of contact between the paper and the platen is small, it is easy to correct this offset. When the paper is conveyed, offsetting or meandering of the paper does not occur, and an auxiliary roller as in a conventional case is not required.

Although the present invention has been described in specific terms, it should be noted here that the described embodiments are not necessarily exclusive and that various changes and modifications may be imparted thereto without departing from the scope of the invention, which is limited solely by the appended claims.

What I claim is:

1. A printer comprising a platen and an opposed printing head, a platen cover disposed in close proximity about said platen and having an opening juxtaposed to said printing head, said platen cover extending around said platen for more than 180°, said platen cover having an outer partial cylindrical surface, a paper guide disposed about said platen cover and having an inner partial cylindrical surface opposite said outer partial cylindrical surface of said cover, said inner and outer partial cylindrical surfaces being spaced from one another to define a guide passageway therebetween such that paper passes through said paper guide passageway to said opening where said paper is printed by said printing head.

2. A printer according to claim 1, further comprising a casing means, said casing means having a paper passageway through which said paper exits after having been printed between said platen and said print head.

3. A printer according to claim 2, further comprising support means on said platen cover and on said casing means for supporting said platen cover on said casing means.

4. A printer comprising a platen and an opposed printing head, a shaft substantially parallel to said platen, a platen cover mounted on said shaft and disposed in close proximity about said platen and having an opening juxtaposed to said printing head, said platen cover extending around said platen for more than 180°; said platen cover having an outer partial cylindrical surface, a paper guide disposed about said platen cover and having an inner partial cylindrical surface, said inner and outer partial cylindrical surfaces being spaced from one another to define a paper passageway therebetween such that paper passes through said paper guide passageway to said opening where said paper is printed by said printing head.

* * * * *